United States Patent [19]

Kennoy

[11] 4,052,064

[45] Oct. 4, 1977

[54] BASKETBALL GAME

[76] Inventor: John T. Kennoy, 421 Horsham Road, Horsham, Pa. 19044

[21] Appl. No.: 605,201

[22] Filed: Aug. 15, 1975

Related U.S. Application Data

[63] Continuation-in-part of Ser. No. 483,420, June 26, 1974, abandoned.

[51] Int. Cl.[2] ..... A63F 7/06

[52] U.S. Cl. ..... 273/85 R; 273/95 E

[58] Field of Search ..... 273/85 R, 94 R, 95 E

[56] References Cited

U.S. PATENT DOCUMENTS

| | | | |
|---|---|---|---|
| 1,523,686 | 1/1925 | Davies | 273/85 R |
| 1,619,279 | 3/1927 | Wagner | 273/85 R |
| 1,712,073 | 5/1929 | Fowler | 273/94 R |
| 1,712,159 | 5/1929 | O'Donnell | 273/85 R |
| 2,201,560 | 5/1940 | Nelson | 273/85 R |
| 2,261,448 | 11/1941 | Petersen | 273/85 R |
| 2,343,506 | 3/1944 | Hay | 273/85 R |
| 2,421,220 | 5/1947 | Robinson et al. | 273/85 F |
| 2,611,615 | 9/1952 | Watson et al. | 273/85 R |

*Primary Examiner*—Anton O. Oechsle
*Assistant Examiner*—Harry G. Strappello

[57] ABSTRACT

A game board with a resilient surface which simulates a miniature basketball court with the usual markings thereon; together with some highly advantageous additional markings, game pieces representing the appropriate number of players on each team, a game piece representing the basketball, a game piece representing the ball handler, or shooter; score indicators, and a cooperating set of game rules; which, together, result in a game requiring considerable skill and generating greatly enhanced and sustained interest on the part of the players of the game as well as that of observers.

1 Claim, 6 Drawing Figures

BASKETBALL GAME

This application is a continuation-in-part of my presently pending Application Ser. No. 483,420, filed June 26, 1974 entitled "Basketball Game", and now abandoned.

The present invention relates to simulated basketball games of the type usually played indoors on a table or other stand and involve a number of playing pieces including a disc which is pressed by hand against another game member to project the latter into the air in an attempt to drop it through an adjacently disposed simulated miniature basketball goal.

Another object is to provide a game of the type described but which, to a very substantial extent, is patterned after an actual basketball game, and in this manner greatly stimulates the interest of both the players themselves and that of observers.

Another object is the provision of a simulated miniature basketball game which may be relatively easily and expensively produced.

The foregoing and other objects and advantages will become more easily understood from the following description and annexed drawings wherein like reference characters designate like parts.

Figure 1:
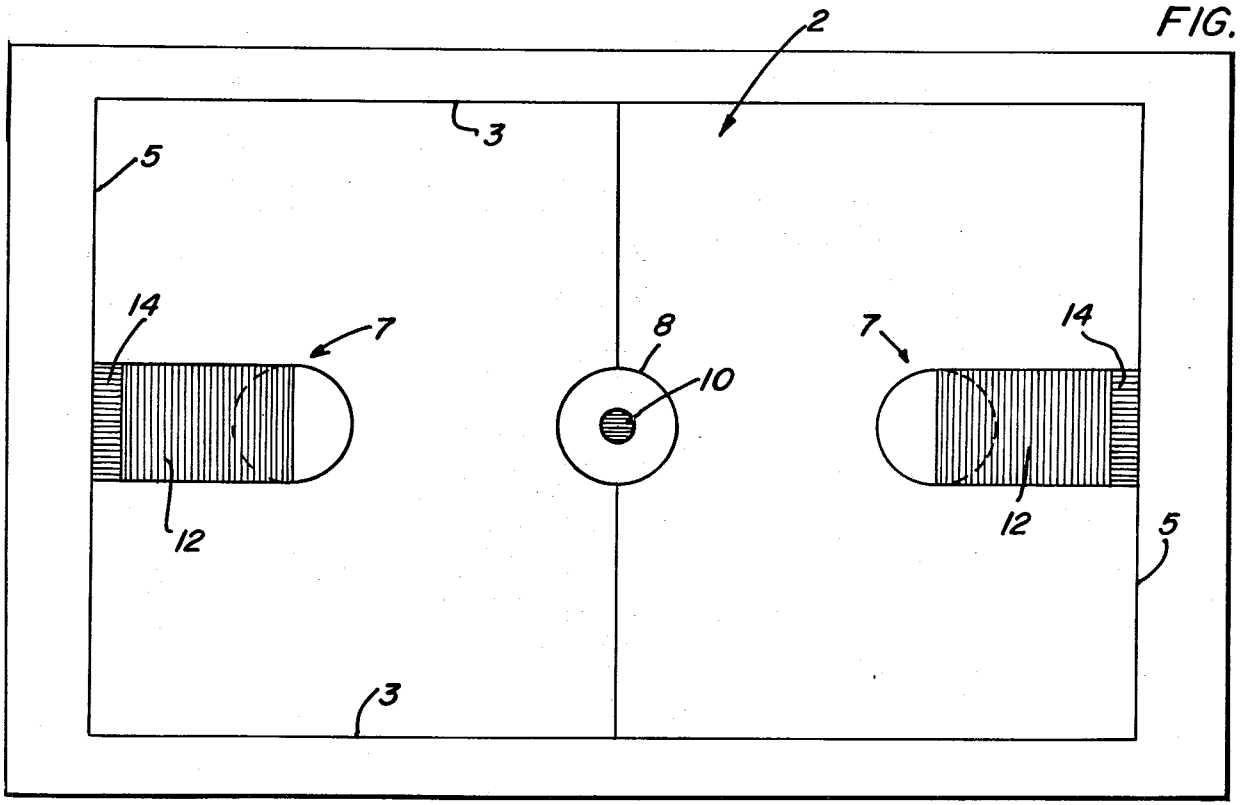
FIG. 1 is a plan view of a game board which embodies some of the teachings of the present invention.

Referring more particularly to the drawings, the numeral 2 generally designates the game board of the apparatus which may be of any desired size and of any suitable material; for example a section of five eigths inch plywood which is 38 inches long and 24 inches wide, with the playing area 32 inches long and 20 inches wide; the same being covered with four laminations of felt sheet with a superposed covering of white cotton sheet.

This 36-inch by 20-inch playing area is delineated by side lines 3 and end lines 5 of any desired color; and it contains basket areas 7 and a central circular area 8 with a center jump circle 10.

According to the illustrative embodiment of the game board, the foul lanes 12 are colored red, with an area 14 under the baskets colored blue. The small jump circle 10 in the center circular area 8 is also colored blue.

Figure 2:
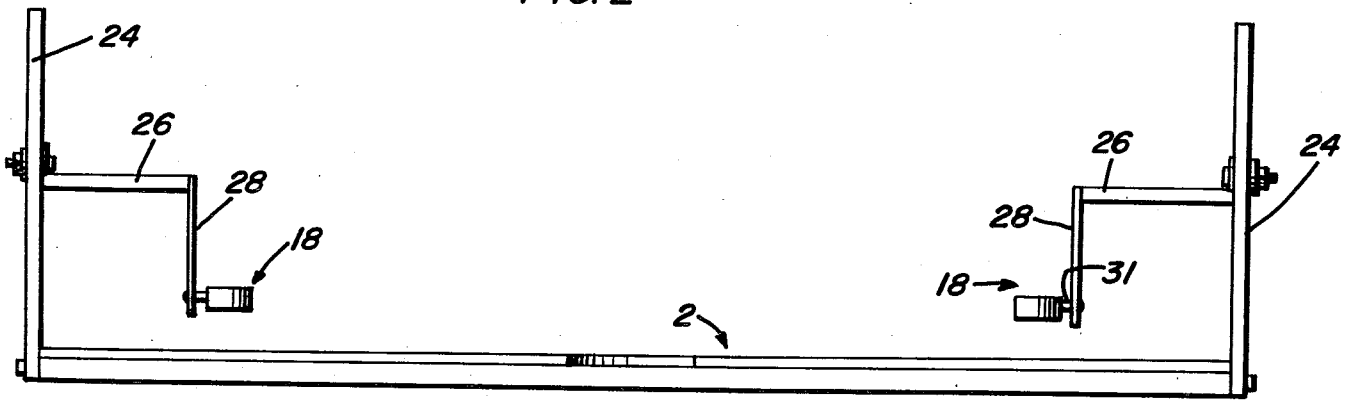
FIG. 2 is a side elevational view of the game board of FIG. 1.

In FIG. 2 there is shown, in plan, one of the two simulated basketball baskets, the same being in the form of a short annular sleeve 18, which may be of any suitable material, and which has a plastic pin 20 extending transversely therethrough, the purpose of which will appear hereinafter.

At the middle of each of the ends of the gameboard 2 there is a suitably secured vertically extending panel 24, at the approximate middle of which there is an inwardly extending horizontally disposed supporting arm 26.

Figure 3:
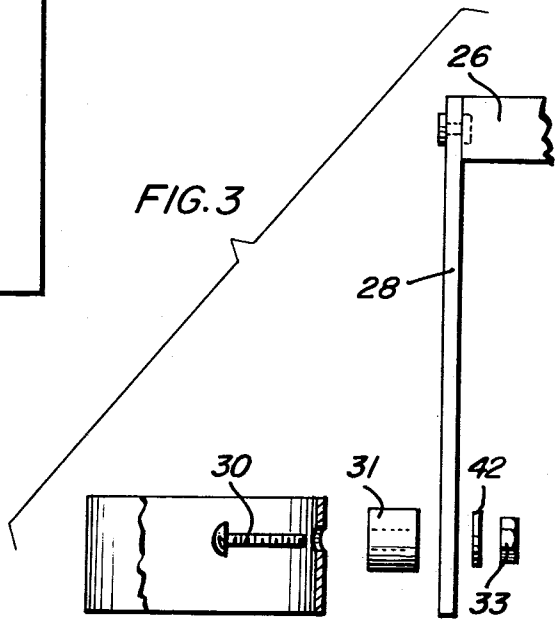
FIG. 3 is a fragmentary elevation, partly exploded view illustrating the details of a portion of one of the backboards, and associated instrumentalities.
Figure 4:
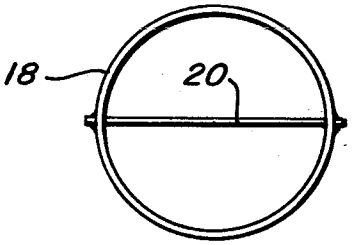
FIG. 4 is a front elevation of the backboard of FIG. 3.

From the outer end of each of the vertically extending members 24 there is a vertically depending backboard 28; and each of the short annular sleeves or simulated baskets is secured at a suitable height above the surface of the gameboard 2, to one of these vertically depending backboards 28, as by means of the bolt, spacer block, lock washer arrangement, as shown in FIG. 3, and designated therein by the numbers 30, 31, 42 and 33, respectively.

Figure 5:
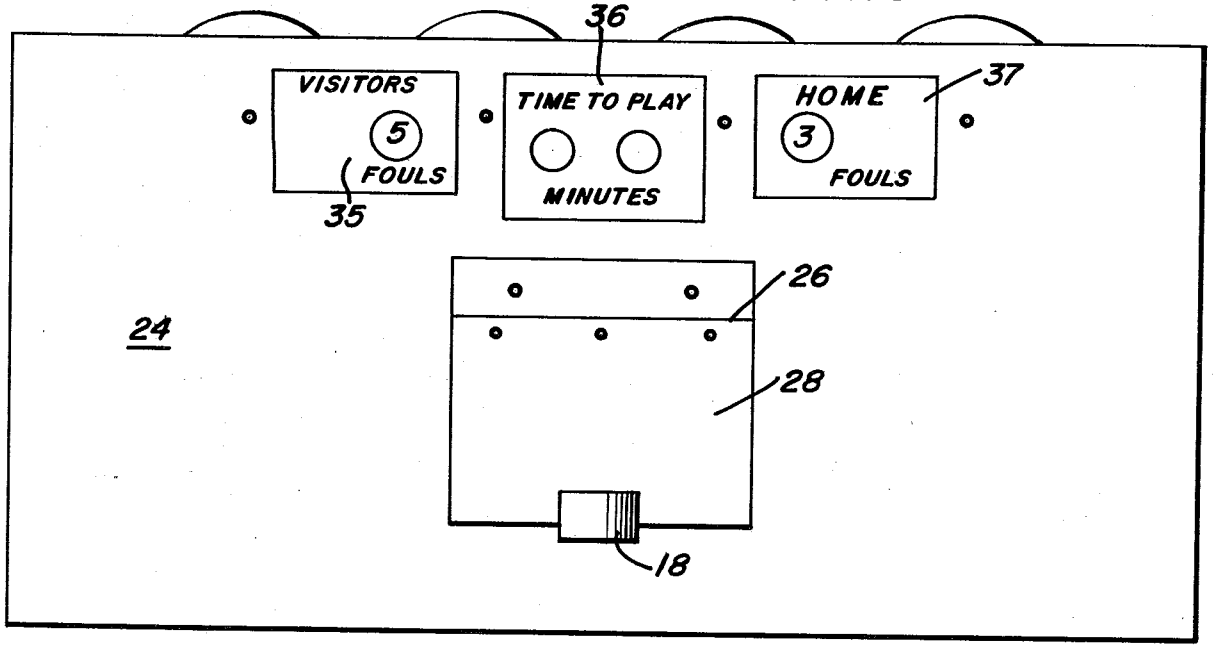
FIG. 5 is a front elevational view of the other backboard of the game board of the invention.

Referring to FIG. 5, each of the vertically extending panels 24 is preferably provided with suitable scoring indicia, generally designated at 35, 36 and 37; but which as such form no part of the invention.

Figure 6:
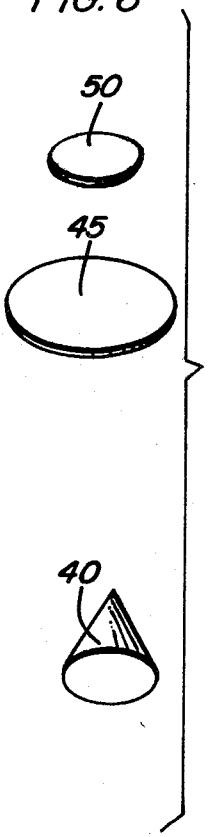
FIG. 6 are perspective views of the playing elements of the game of the invention.

Referring to FIG. 6, there are 10 identical playing pieces 40, five of one color (such as red) and five of another color (such as blue). These ten pieces are considered as defensive pieces, and may be formed of any suitable material including plastics, etc. The large flat plastic disc 45 is the shooting disc. The small flat plastic disc 50 serves as the ball.

The ten playing pieces 40 are shown as conical and they may acceptably be ¾ inch in diameter at the base, and 1 inch in height.

Before starting the game, both players must agree on

A. the basket at which they will shoot. (This basket selected is in the players front court, making the other court the players back court).

B. the color of the defensive pieces 40 they will use.

C. the time of the game.

1. The game is played basically like any real basketball game with rules that pertain to a certain court, and is started with a jump ball in the center jump circle 10. The player receiving the ball 50 will keep passing or shooting the ball until one of the following occur:

A. a field goal is made.

B. a foul is called.

C. a jump ball is called.

D. a turnover occurs.

SCORING

2. A Field Goal counts two points, a Foul Shot counts one point. After a player makes a score, the other player receives the ball 50 out of bounds at the end of the court where the goal is made. A Field Goal is made by shooting the ball through the basket 18 during the regular play of the game. A Foul Shot is made by shooting a free shot after a foul has been called.

TIME OF THE GAME

3. There are several ways to time the game, one way must be agreed on before starting the game.

A. Advance the time one minute with every score, whether or not it is a field goal or a foul shot.

B. Advance the time one minute with each turnover of the ball.

C. Agree on a final score and the first player to reach the score wins.

Note: Players are required to change goals at the half time. Agreement must also be made on how long each quarter or half will be.

DEFENSE

4. Each player receives five defensive pieces 40 and a shooting disc 45. The five defensive pieces 40 are placed by each player in his back court in any manner or formation desired, the only rule in setting up the defense is that no more than one defensive piece 40 can be placed in a red area.

DEFENSIVE CHANGES

5. A time out must be called before any defensive piece or pieces 40 can be moved. The ball 50 must be in the possession of the player calling the time-out or must be out of bounds.

TIME-OUTS

6. Each player is allowed two time-outs each half. Any player using more than two time-outs in each half is charged with a technical foul.

PASSING THE BALL

7. The shooting disc 45 is placed on the edge of the ball and pressed quickly or snapped downward making the ball 50 move. Passes can be made at any place on the court of from out of bounds onto the court, subject to the rules of the game.

SHOOTING THE BALL

8. Shots are made in the same manner as passing, only they are directed at the basket 18. Shots can be taken at any place on the white or uncolored part of the court. The ball 50 cannot be shot from the red area unless it stops in the red area on a rebound, a pass from the back court or a pass from out of bounds.

JUMP BALL

9. A Jump Ball is called
A. to start the game.
B. to settle any disagreements.
C. when the ball 50 stops, touching a blue area under either basket or in the center jump circle.
D. if the ball stops balanced on the basket.

The jump ball is accomplished by one player hiding the ball 50 in one of his closed hands or fists and placing both hands or fists on the court. The other player chooses one of the hands. If he chooses the correct hand he gets the ball. If he chooses the wrong hand the other player gets the ball.

The ball 50 is then placed at any spot in the jump circle 8 closest to the place the jump ball was called.

Note: Each half or quarter of the game is started with a jump ball at the center jump circle 10.

TURNOVERS

10. Turnovers occur when
A. possession is lost by a jump ball.
B. a foul lane violation is called.
C. a back court violation is called.
D. a front court violation is called.
E. a traveling violation is called.
F. the ball touches a defensive piece.
G. a boundary violation is called.
H. a foul is called.

FOUL LANE VIOLATIONS

11. When the ball 50 stops in the red area it must be passed out of the lane in one try or if it can be shot at the basket 18 (see rule #8) it must touch the backboard 28 or basket 18. If it does not clear the red area in one try it is called too much time in the foul lane and becomes a lane violation. The ball is then awarded to the other player out of bounds at the side of the court.

BACK COURT VIOLATION

12. When taking the ball out of bounds, intercepting a pass or receiving a rebound, the player has two tries to move the ball in the front court. If he fails to do so, it is called too much time in the back court and becomes a back court violation. The ball is then awarded to the other player out of bounds at the side of the court.

FRONT COURT VIOLATION

13. If the ball crosses from a player's front court to the back court, it is called a front court violation and the ball is awarded to the other player out of bounds at the side of the center court line.

TRAVELLING VIOLATION

14. If the ball is dragged by the shooting disc 45 as a player is trying to pass or shoot the ball, it is called a travelling violation and the ball is awarded to the other player out of bounds at the side of the court.

INTERCEPTION

15. If the ball touches a defensive piece, while being shot or passed, the ball is intercepted and awarded to the other player at the spot where it stops. If the ball goes out of bounds after touching a defensive piece, it is awarded to the player opposite the defensive piece. If the ball stops on the center line it is considered intercepted and is awarded to the other player at the spot it stops on the line.

BOUNDARY VIOLATION

16. If the ball touches or crosses the boundary line, it is considered a boundary violation and is awarded to the other player out of bounds where the violation occurs. If the ball stops on the boundary line when it is being passed onto the court from out of bounds, it also is considered a boundary violation.

Note: The top of the backboard 28 or backboard brace 26 is considered out of bounds.

PERSONAL FOULS

17. If the ball stops touching a defensive piece, it is a personal foul and the defensive player is awarded a free shot from his foul line. If the ball stops on its edge leaning against a defensive piece, the defensive player is awarded two foul shots from his foul line.

TECHNICAL FOULS

18. When a technical foul is called the player shooting the foul also receives the ball out of bounds at center court after the foul shot, whether or not the shot is made. The technical foul counts one point the same as a personal foul shot.

DOUBLE FOULS

19. If the ball stops in the blue area 10 of the center jump circle 8, touching the center court line, without touching the small jump circle line, it is a double foul allowing each player a foul shot after which there is a jump ball at center court.

OFFENSIVE FOULS

20. If a player knocks over or moves a defensive piece 40 of the other player's with his shooting disc 45, while passing or shooting the ball 50, it is called an offensive foul and the ball is awarded to the other player out of bounds at the side of the court. There is no free shot on an offensive foul.

FOUL SHOTS

21. Foul shots are taken by moving the ball 50 to the players free throw line and taking a shot at the basket from this point. The ball must not touch the foul line or foul circle 8. If there are any defensive pieces 40 normally set in this area, they must be moved out of the circle while the foul shot is being attempted. If the foul shot is missed and does not touch the basket 18, it is awarded to the other player, either where it stops on the court as a rebound or out of bounds at the end 3 of the court. If the foul shot is missed and the ball touches the basket, the player shooting the foul shot retains possession of the ball, providing it does not touch a defensive piece or go out of bounds.

BONUS FOUL SHOTS

22. A bonus foul shot is awarded a player for each foul shot taken, starting with the fourth personal foul committed during a half of the game, providing the player shooting the foul shot makes the first shot.

VARIATION IN GAME RULES

23. Game rules can be varied to the players ideas to make the game more interesting to any particular group of players such as drawing in a radius line of 10 inches from center of backboard across each front court and allowing a three point goal for each shot made from back of this area.

FOR ADVANCED PLAYERS

24. By using a ball disc red on one side and blue on the other, more skill will be required to play the game. When using this multicolored disc, shots at the basket can be taken only when the blue side of the disc is up. This will necessitate more passing and movement of the ball to get a shot at the basket; also causing more turnovers and more difficult shots to be taken.

Note: If a basket is made by shooting the ball disc, with the red side up, it must be considered offensive goal tending and become a turnover, giving the ball to the other player out of bounds at the end of the court. No score is to be counted.

RESUME

The "baskets" 18 may be made of plastic rings one and one-half inches in diameter and three quarters of an inch long, with the basket pins 20 1½ inches long and one-eighth inches in diameter inserted across the diameter of the basket 18 at one quarter of an inch from one end. Another hole, one quarter of an inch in diameter, and one quarter of an inch from and in line with the basket pin 20, is provided with the basket mounting hole.

The two end boards 24 that hold the basket 18 and backboard 28 assemblies are secured to the game board by five wood screws. One end board holds the timer board 36 and foul boards 35 and 37. The other end board 24 holds the players score boards. The score, foul and time boards are made of cardboard discs four inches in diameter mounted to the end boards with eight bolts and nuts. These discs are set and marked to show the number desired through a one-half inch hole in the end board 24. Shooting discs 45 may be one and one-half inches in diameter, the ball discs may be one half inch in diameter 50, and three thirty-seconds of an inch in thickness. The defensive pieces 40 are conical in design and may suitably be one inch in height and three quarters of an inch in base in diameter of one color and five of another and conflicting color, such as red/blue, etc.

Referring to FIG. 1, the game board 2 of the apparatus which may be of any size desired, but large enough to allow effective movement of the shooting disc 45 and the ball disc 50 shown in FIG. VI, by the players hands. Consideration should be given as to how large the game board 2 can be in order for the players to conveniently reach all points of the game board. The game board 2 padding should have enough resilience to propel the ball disc 50 when playing the game.

The playing area should be delineated with side lines 3 and end lines 5. (See rule 16). Containing a center line 9 parallel to the end lines 5 dividing the playing area into each players front and back courts. (See rules A-12-13). The center circle 8 and concentric jump circle 10 are located in the center of the playing area; and add extra dimensions to the game. (See rules 9–19). The foul circles 7 are located at the end of the foul lanes 12. Foul lines 4 are the diameters of the foul circles 7 which are parallel to the end lines 5. (See rules 17-19-19-21). The foul lanes 12 have the same width as the foul lines 4 and extend to the end lines 5. (See rules 4-8-11). The backboards 28 are centered over the foul lanes 12, a short distance from the end lines 5. (See FIG. IV). Areas 14 are delineated by a line drawn across the foul lanes 12 directly under the backboards 28 and extending to the end lines 5. Areas 14 are called jump areas. (See rule 9) which prevents damage to the backboards 28.

All circles, lines, jump circles 10, foul lanes 12 and 14 can be of any color, providing areas 10 and 14 are of one color and area 12 of another color. The padding of the game board is preferably of any neutral color that will accentuate the color of the lines, circles, foul lanes and jump areas.

As indicated in FIG. II the backboards 28 and baskets 18 are sufficiently elevated to allow ample movement of the ball disc 50 by the shooting disc 45 but not enough to make scoring too difficult. Backboard braces 26 hold the backboards 28 away from the end boards 24 to a position over lines between areas 12 and 14 of the foul lanes.

Referring to FIG. III the baskets 18 serve as goals through which the ball disc 50 must pass for a player to score. (See rule 2). The basket pins 20 delay the ball disc 50 when passing through the basket 18 to assure a score has been made. The baskets 18 should be large enough for the ball disc 50 to pass through but not so large as to make scoring too easy.

As indicated in FIG. IV the baskets 18 are offset from the backboards 28 to allow scores to be made by rebounds off of the backboards. The backboards 28 serve as a target board when shooting at the baskets 18 and are sized to allow shots to rebound back to the playing area but not so large as to cover score boards, time boards, foul boards or interfere with the maneuvering of the shooting disc 45 or the ball disc 50 beyond the end lines 5.

Shown in FIG. V is one of the two end boards 24 that hold the baskets 18 and backboards 28 assemblies and prevent the ball disc 50 from passing off the end of the game board 2. One of the end boards holds the foul boards 35 and 37 and the time board 36. The other end board (not shown) holds both players score boards and, of course, is similar in construction.

Referring to FIG. VI, two shooting discs 45, one ball disc 50 and 10 defensive pieces 40 are required, the same being plastic discs of such size as to allow easy control by the players hands. The defensive pieces 40 can, of course, be of any suitable material, such as plastic, metal wood or glass. Their design can be round, square, or conical and sized to add some degree of difficulty to playing of the game. These defensive pieces 40 may be of any color; however, each player should have a different colored set of five pieces.

Having thus described the invention, what I claim as new and desire to secure by Letters Patent is:

1. A table-type simulated basketball game comprising, in combination, a rectangular playing board having a resilient upper surface providing a playing field of dimensions which are in general proportion to the standard athletic basketball court and defining end lines, side lines, foul circles and foul lanes which are parallel with said side lines, said game including a. a vertically disposed and elevated backboard at each end of the playing field;

b. a horizontally disposed annular ring attached to each of said backboards in simulation of a basketball basket;

c. movable basketball simulating playing discs of the tiddleywinks type;

d. a manually-operated shooting piece for cooperation with said playing discs;

e. said playing discs and said manually-operated shooting piece for cooperation therewith being of such size, shape and consistency as to permit the latter to be so manually activated as to propel said playing discs into said annular rings;

f. means within said annular rings for retarding the falling movement of said playing discs through the horizontally disposed annular rings carried by said backboards;

g. a circle at the center of the playing field;

h. a concentric jump circle within said first-named circle and i. a marked area directly under each of said annular rings;

j. said marked areas and said jump circle being of substantially the same color;

k. said foul lanes having a color which contrasts with the color of said marked areas and said jump circle;

l. the halves of the foul circles which are adjacent the foul lanes being of substantially the same color as that of the foul lanes;

m. the playing discs on one side having a color which at least resembles that of the foul lanes, and on the other side of a color which at least resembles the color of the jump circle and the aforementioned marked areas.

* * * * *